United States Patent [19]

Fujikawa et al.

[11] Patent Number: 4,722,306

[45] Date of Patent: Feb. 2, 1988

[54] VALVE GEAR FOR FOUR-CYCLE ENGINE

[75] Inventors: Tetsuzo Fujikawa, Kobe; Makizo Hirata; Shinichi Tamba, both of Kakogawa; Noriyuki Ueki, Kashi, all of Japan

[73] Assignee: Kawasaki Jukogyo Kabushiki Kaisha, Japan

[21] Appl. No.: 864,503

[22] Filed: May 19, 1986

[30] Foreign Application Priority Data

May 20, 1985 [JP] Japan ..... 60-108915
Sep. 2, 1985 [JP] Japan ..... 60-194156

[51] Int. Cl.[4] ..... F01L 1/00
[52] U.S. Cl. ..... 123/90.2
[58] Field of Search ..... 123/90.2, 90.6, 90.24

[56] References Cited

U.S. PATENT DOCUMENTS

| | | | |
|---|---|---|---|
| 1,101,352 | 6/1914 | Sumbler | 123/90.2 |
| 1,174,748 | 3/1916 | Marck | 123/90.2 |
| 1,248,597 | 12/1917 | Baker | 123/90.2 |
| 1,490,613 | 4/1924 | Leport | 123/90.2 |
| 2,485,951 | 10/1949 | Zimmerman | 123/90.2 |
| 2,843,095 | 7/1958 | Prentice | 123/90.2 |

FOREIGN PATENT DOCUMENTS

| | | | |
|---|---|---|---|
| 421654 | 2/1911 | France | 123/90.2 |
| 476772 | 4/1915 | France | 123/90.2 |
| 450469 | 4/1915 | France | 123/90.2 |
| 552302 | 4/1923 | France | 123/90.2 |
| 658038 | 5/1929 | France | 123/90.2 |
| 2327 | of 1895 | United Kingdom | 123/90.2 |

OTHER PUBLICATIONS

French Patent to Tcherepanoff, 5/15.

*Primary Examiner*—Ronald B. Cox

[57] ABSTRACT

A valve gear adapted for the four-cycle engine comprises guide portions(s) which is formed on the end surface(s) of crankweb(s) of a crankshaft, and has such a shape folding around the crankshaft with an intersection as to return back to a starting point in two turns; and two interlocking mechanisms provided between the guide portion(s) and the intake and exhaust valves in the engine to open the valves by being guided by the guide portion(s).

5 Claims, 11 Drawing Figures

VALVE GEAR FOR FOUR-CYCLE ENGINE

FIELD OF THE INVENTION AND RELATED ART STATEMENT

This invention relates to a valve gear adapted for a small general-purpose four-cycle engine.

Generally, the small general-purpose four-cycle engine requires low cost, light weight and compactness.

To meet aforesaid requirements, the applicant of the invention has previously proposed, in the U.S. Pat. No. 811,890, a valve gear wherein guide portions are formed at two locations on the output shaft connected to the crankshaft, and respectively provided with interlocking mechanisms to open the intake and exhaust valves, thus eliminating the cam shaft to make the engine small and compact.

But, in aforesaid gear, provision of the two guide portions causes the output shaft to become long, thus making the outline of the engine large, and also provision of a cutout on the output shaft induces the decrease in the crankshaft strength.

Another problem lies in the rather large crankcase resulting from the longer bearing-to-bearing distance of the crankshaft as well as the larger overhang of the sliding arms in the interlocking mechanisms.

OBJECT AND SUMMARY OF THE INVENTION

In view of aforesaid problems in the valve gear previously proposed by the inventor, it can be said that the purpose and object of this invention is to provide a valve gear adapted for a four-cycle engine wherein an output shaft as well as a bearing-to-bearing distance of a crankshaft are designed not long, thus realizing a small engine with a small crankcase and without the crankshaft strength lost.

To achieve aforesaid object according to the invention, a valve gear adapted for the four-cycle engine comprises guide portions formed on the end surfaces of crank webs in a crankshaft, which have respectively one intersection of such a shape folding the crankshaft as to return back to a starting point in two turns, and interlocking mechanisms guided by the guide portions to open the valves in the engine.

BRIEF DESCRIPTION OF THE DRAWINGS

In the accompanying drawings, there are shown illustrative embodiments of the invention from which these and other of the objectives, novel features and advantages will be readily apparent.

In the drawings.

DETAILED DESCRIPTION OF THE PREFERRED EMBODIMENTS

Figure 1:
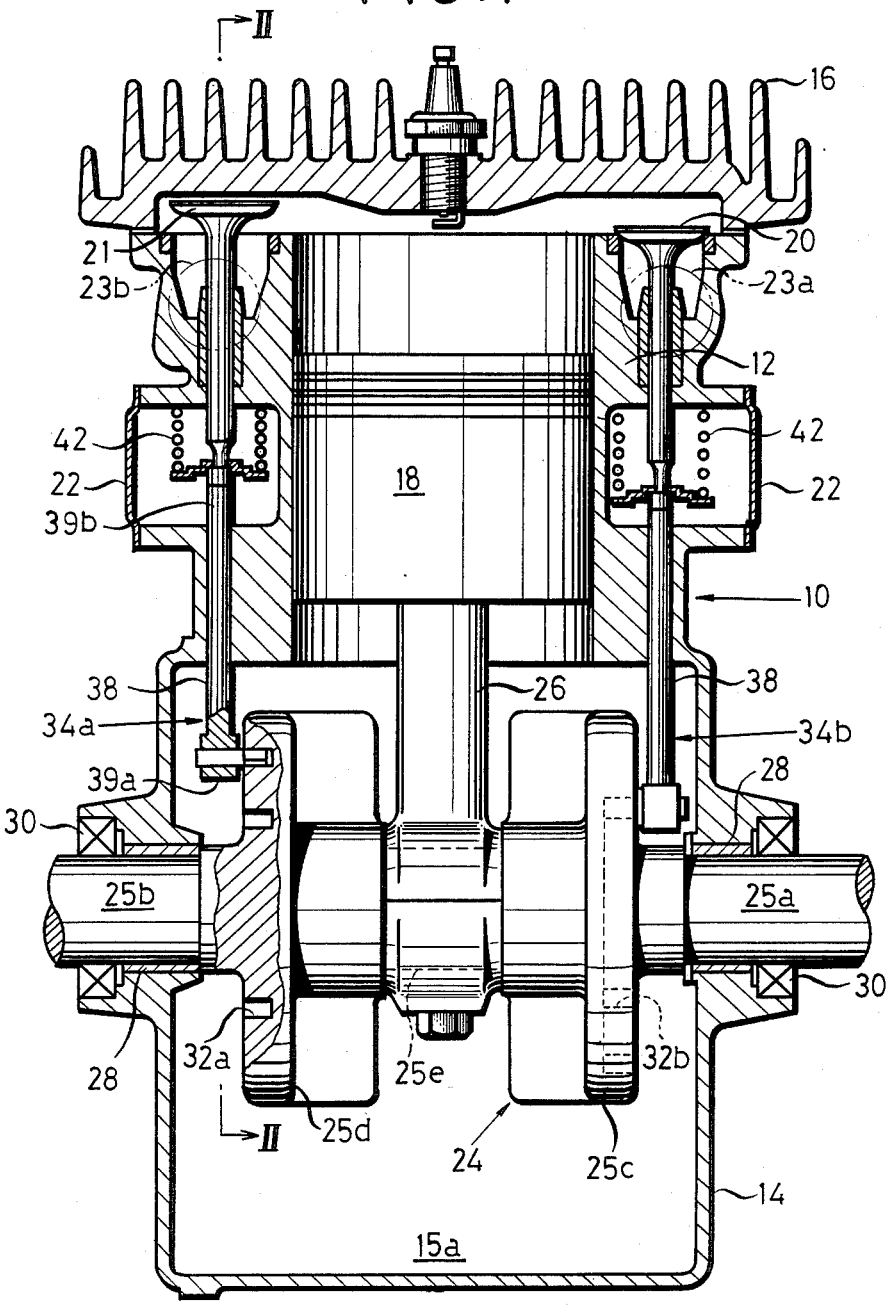
FIG. 1 is a vertical sectional view of a first embodiment adapted for a four-cycle engine according to the invention.

The following describes a valve gear of a first embodiment according to the invention adapted for a small, general-purpose four-cycle engine with side valves, referring to FIG. 1.

In FIG. 1, Numeral 10 designates an engine block, wherein a cylinder 12 and a crankcase 14, etc. are built into one piece. The cylinder 12 is equipped with a cylinder head 16 at the upper end thereof. A piston 18 is slidably inserted into the inside bore of the cylinder 12.

An exhaust valve 20 is disposed at the right side of aforesaid cylinder 12, and an intake valve 21 similarly at the left side thereof. Numeral 22 is a removable side cover, and Numerals **23*a* and 23*b*** are respectively exhaust and intake passages disposed in a direction at right angles with the drawing paper.

The crankcase 14 rotatably houses a crankshaft 24 of both ends supported type, and its bottom serves as an oil pan **15*a*. The crankshaft 24 is one-piece forging combining output shafts 25*a* and 25*b*, crankwebs 25*c* and 25*d*, and a crank pin 25*e*. The crank pin 25*e* is connected with the piston 18 through a connecting rod 26. Aforesaid output shafts 25*a* and 25*b* are supported by the crankcase 14 through metal bearings 28 at both ends thereof. Numeral 30** designates oil seals.

Figure 2:
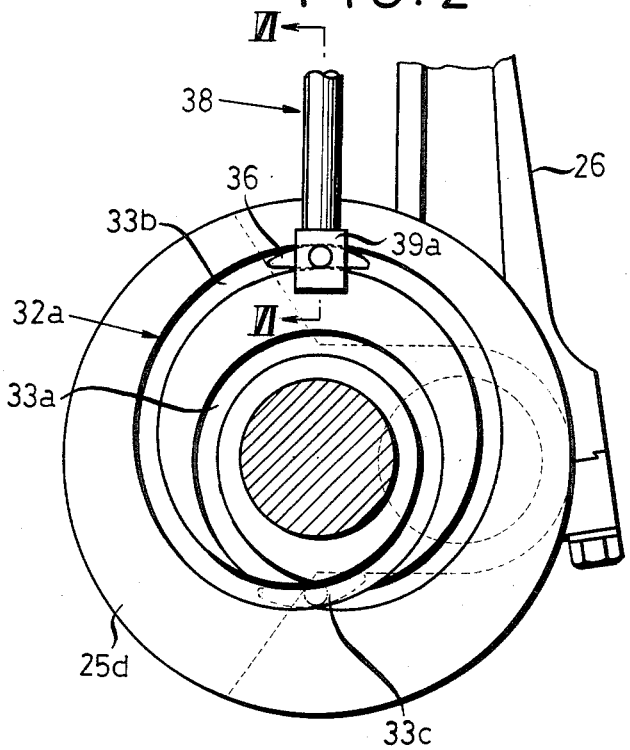
FIG. 2 is a partially sectional view taken along II—II in FIG. 1.

The crankweb **25*d* has a guide groove 32*a* (guide portion) for the intake valve 21 at its left end surface. The guide groove 32*a* has, as shown in FIG. 2, such a loop folding around the output shaft 25*b* as to return back to a starting point in two turns, and consists of a valve closing portion 33*a* for closing the intake valve 21, a lifting portion 33*b* for opening, and an intersection 33*c* connecting the valve closing portion 33*a* to the lifting portion 33*b***.

The valve closing portion **33*a* is formed essentially concentrically to the axis of the output shaft 25*b*, while the lifting portion 33*b* eccentrically to the axis of aforesaid output shaft 25*b* to give the intake valve 21 a given lift through an interlocking mechanism 34*a*** detailed later.

Figure 3:
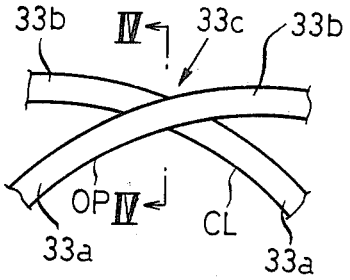
FIG. 3 is a plan view of an intersection.
Figure 4:
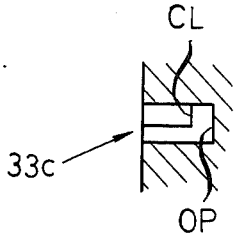
FIG. 4 is a sectional view taken along IV—IV in FIG. 3.

Additionally, at the intersection **33*c*, as shown in FIGS. 3 and 4, the valve closing stroke CL returning back to the valve closing portion 33*a* from the lifting portion 33*b* is formed shallower in depth than the valve opening stroke OP of the intake valve 21 advancing to the lifting portion 33*b* from the valve closing portion 33*a***.

The interlocking mechanism **34*a* consisting of a follower 36 and a tappet 38, wherein the follower 36 is slidably in contact with the guide groove 32, functions to convert the rotational motion of the crankshaft 24 into the vertical reciprocating motion of the intake valve 21, thus allowing the intake valve 21** to lift and close.

Figure 5:
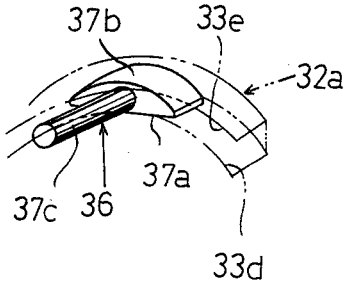
FIG. 5 is a perspective view of a follower.

The follower 36 has, as shown in FIG. 5, a lower surface **37*a* (sliding contact surface) sliding on the inner wall 33*d* of the guide groove 32*a*, an upper surface 37*b* (guide surface) guided by the outer wall 33*e* thereof, and a stem 37*c* put together with the body of both surfaces as one-piece. The lower surface 37***a* has basically a flat shape so as to have a linear contact with the inner wall 33*d*. On the other hand, the upper surface 37*b* has a curved shape with a radius of curvature slightly smaller than the smallest one of the outer wall 33*e* so as to rock the follower 36 along the guide groove 32*a* while making a sliding contact with the outer wall 33*e*.

Figure 6:
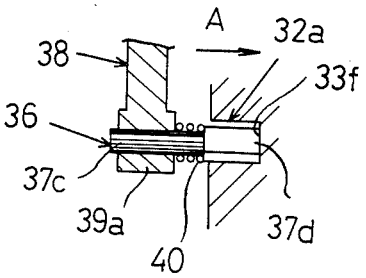
FIG. 6 is a sectional view taken along VI—VI in FIG. 2.

The stem 37*c* of the follower 36, as shown in FIG. 6, fits into a boss 39*a* of the tappet 38 so as to rotate about its own axis and slide in its axial direction. A compressed coil spring 40, provided around the stem 37*c* between the follower 36 and the tappet 38, presses an end surface 37*d* of the follower 36 by the spring force in the direction of Arrow A, i.e. against a bottom face 33*f* of the guide groove 32*a*. A snap ring (not shown), for example, may sometimes be provided at the end of the stem 37*c* to prevent it from working out.

As shown in FIG. 1, an upper portion 39*b* of the tappet 38 slidably extends through the cylinder 12 and depresses up against the lower end of the intake valve 21. On the other hand, the tappet 38 itself is depressed down by the force of a valve spring 42 toward the center of the output shaft 25*b*.

Furthermore, another guide groove 32*b* is cut for the exhaust valve 20 on the crankweb 25*c* shown at the right of FIG. 1, maintaining a phase nearly 180 degrees behind that of the guide groove 32*a*. And another interlocking mechanism 34*b* similar to the interlocking mechanism 34*a* is disposed between the guide groove 32*b* and the exhaust valve 20.

The operation of the valve gear is described below: When the crankshaft 24 rotates, the interlocking mechanisms 34*a* and 34*b* convert the rotational motion of the crankwebs 25*c* and 25*d* into the vertical reciprocating motion of the tappets 38 to open the exhaust and intake valves 20 and 21.

Here, with the interlocking mechanism 34*a*, for example, the follower 36 slides in the guide groove 32*a*, thus raising or lowering the tappet 38 by the offset between the highest position of the valve lifting portion 33*b* and the lowest position of the valve closing portion 33*a*.

In addition, when the follower 36 is passing through the intersection 33*c*, because of the difference in the groove depth provided between the valve opening stroke OP and the valve closing stroke CL, as shown in FIGS. 3 and 4, there is no opportunity of the follower 36 to take the wrong path, i.e. from the valve opening stroke OP to the valve closing stroke CL or from CL to OP, at the intersection 33*c*, and also to suffer a large impact from the cut walls of the wrong stroke groove.

A further provision of the flat lower surface 37*a* and the curved upper surface 37*b* on the follower 36 guides the follower 36 smooth in the guide groove, by keeping a linear contact of the lower surface 37*a* with the inner wall 33*d* of the guide groove 32*a*, as well as by changing the orientation of the follower 36 along the guide groove 32*a* with the upper surface 37*b* kept in contact with the outer wall 33*e* thereof.

As the result, even the guide groove 32*a* with a relatively small radius of curvature can keep the follower 36 to slide on the right track.

Figure 7:
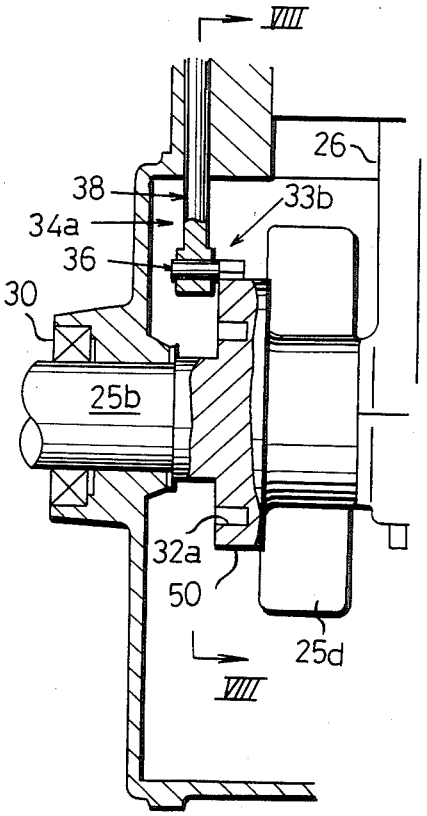
FIG. 7 is a vertical sectional view of the major parts of a second embodiment according to the invention.
Figure 8:
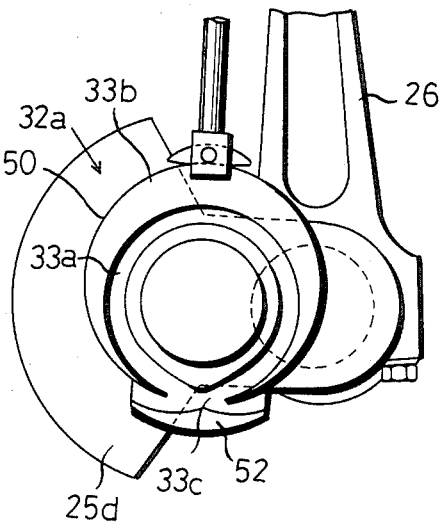
FIG. 8 is a fragmentary sectional view taken along VIII—VIII in FIG. 7.

The following describes a second embodiment according to the invention, referring to FIGS. 7 and 8, in which the like reference numerals are provided for the like or corresponding parts as those in aforesaid embodiment in FIG. 1.

As shown in FIG. 7, the lifting portion 33*b* in the guide groove 32*a* has an inner wall 50, but an outer wall and a bottom face are both removed, compared with the first embodiment, excepting that only a short length of an outer wall 52 (FIG. 8) is disposed at the outside of the intersection 33*c*.

In this connection, the interlocking mechanism 34*b* for the exhaust valve 20 is constructed similarly to the above construction.

In the second embodiment mentioned above, the tappet 38 is depressed down against the inner wall 50 under a force exerted by the valve spring 42 (FIG. 1), which allows the follower 36 to slide along the inner wall 50.

Therefore, the crankweb 25*d* becomes lighter in weight, which makes the balancing of the crankshaft 24 easy even if the guide groove 32 is provided on the end surface of the crankweb 25*d*.

Figure 9:
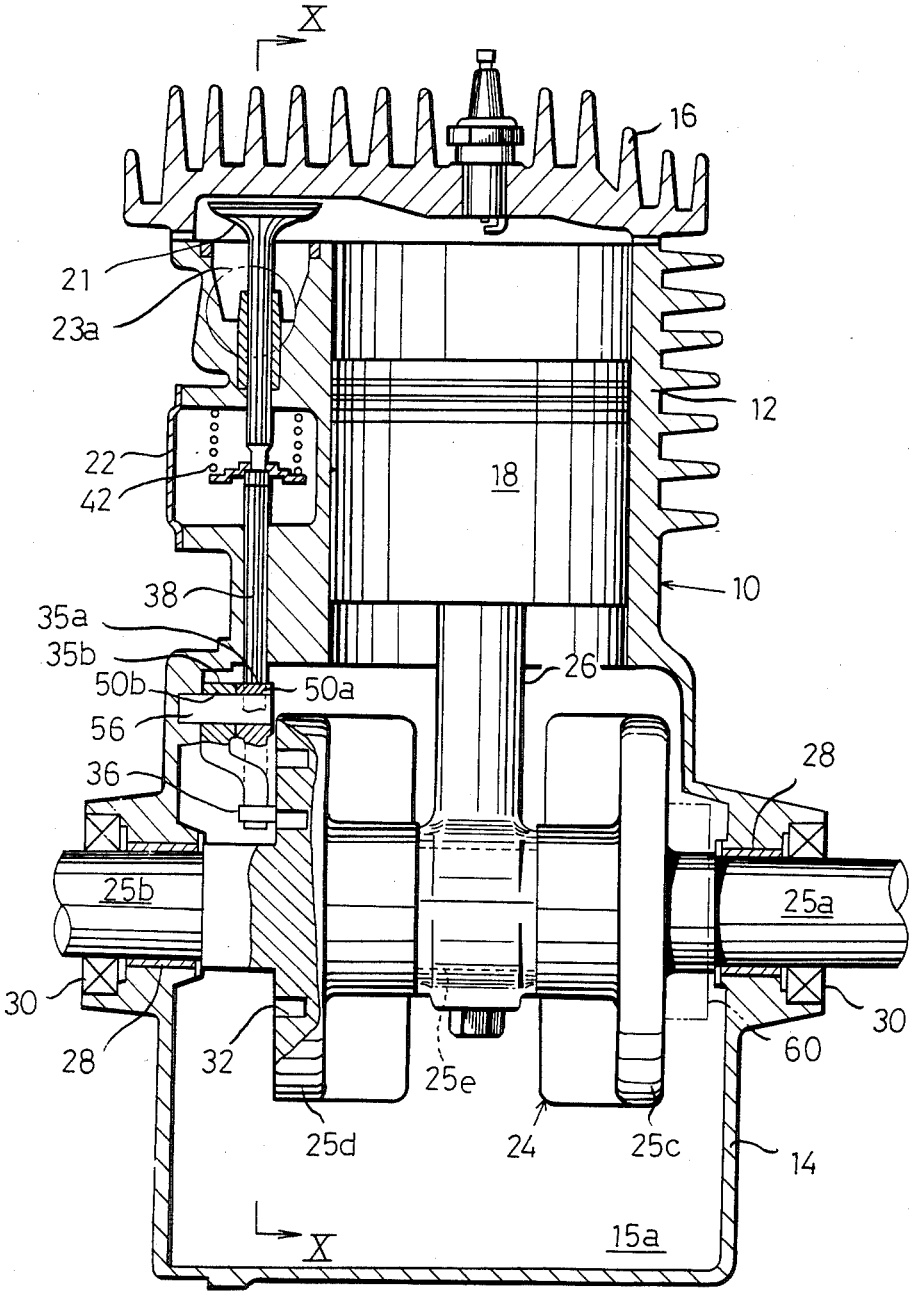
FIG. 9 is a vertical sectional view of a third embodiment adapted for a four-cycle engine according to the invention.
Figure 10:
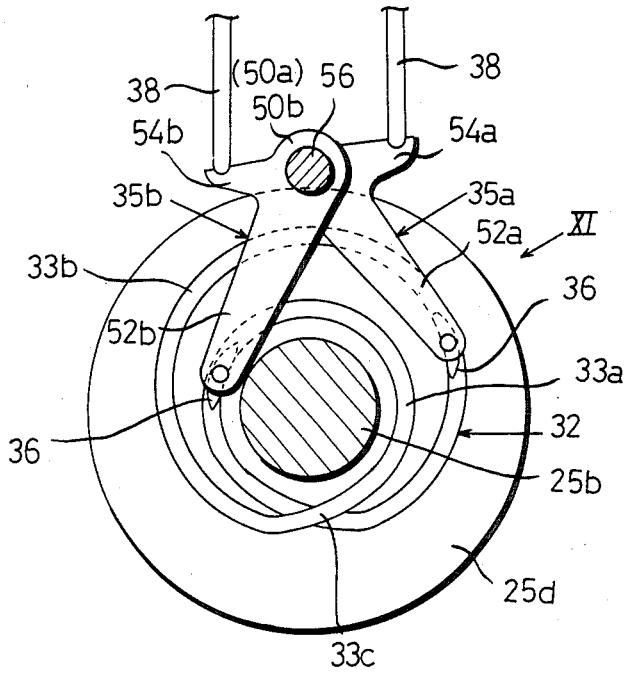
FIG. 10 is a fragmentary sectional view taken along X—X in FIG. 9.
Figure 11:
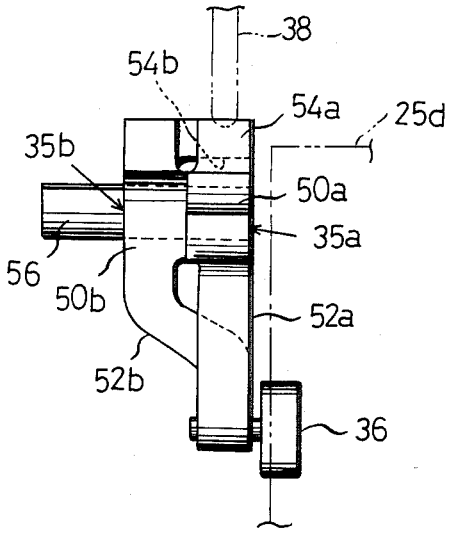
FIG. 11 is a fragmentary view taken in the direction of the Arrow XI in FIG. 10.

The following describes a third embodiment referring to FIG. 9 through FIG. 11. In these drawings, the like reference numerals are provided for the like or corresponding parts as those in aforesaid embodiment shown in FIGS. 1 and 2.

In this embodiment, intake and exhaust valves 21 and 20 are both disposed on the left side of the cylinder block in FIG. 9, but the exhaust valve 20 is not shown because it is hidden behind the intake valve 21.

A guide groove 32 is provided on the left end surface of a crankweb 25*d* shown on the left side of the drawing, to open the intake and exhaust valves 21 and 20, and is, as shown in FIG. 10, much the same in shape as the guide groove 32*a* for opening the intake valve of the first embodiment in FIG. 2, and consists of a valve closing portion 33*a*, a valve lifting portion 33*b* and an intersection 33*c*.

In this embodiment, interlocking mechanisms 34*a* and 34*b* respectively consist of a follower 36, a swing arm 35*a* or 35*b* and a tappet 38.

As shown in FIG. 10, the swing arm 35*a* for the intake valve 21 is a one-piece forging combining a boss 50*a*, and arm 52*a* and a pushing portion 54*a*. The boss 50*a* is supported by a pin 56, fixed to the left side wall of a crankcase 14 and disposed horizontally in the axial direction of a crankshaft 24 (FIG. 9). The arm 52*a* extends vertically along the left end surface of the crankweb 25*d* (FIG. 11), and the pushing portion 54*a* also extends straight at a nearly 80 degree angle (included angle) to the arm 52*a*, and shorter in length than the arm 52*a*.

The follower 36 is installed at the lower end of the arm 52*a*, and the lower end of the tappet 38 is forced down against the upper tip end of the pushing portion 54*a* by a valve spring 42. The follower 36 functions to keep a sliding contact with the guide groove 32, and to change the rotational motion of the crankshaft 24 into the reciprocating motion of aforesaid intake valve 21, thus lifting and closing the intake valve 21.

As shown in FIG. 10, the swing arm 35*b* for the exhaust valve 20 is a one-piece forging consisting of a boss 50*b*, an arm 52*b* and a pushing portion 54*b*, and the boss 50*b* is juxtapositioned on the left side of the boss 50*a* in FIGS. 9 and 11, to be supported by the pin 56. The arm 52*b* bends at its middle portion toward the left end surface of the crankweb 25*d*, and, as shown in FIG. 11, its top end portion is so formed as to be laid over the top end portion of the arm 52*a* when viewed from the direction of Arrow XI.

The arm 52*b* is located to have a phase angle for the crankshaft rotation approximately 180 degrees behind relative to that of the arm 52*a* for the intake valve 21

(FIG. 10), and guided by the same guide groove 32 as that for the arm 52*a* to open the exhaust valve 20 at a given timing. As with the case of aforesaid arm 52*b*, when viewed from the direction of Arrow XI, the end portion of the pushing portion 54*b* is so bent as to be lined up with the pushing portion 54*a* (FIG. 10). As shown in FIG. 10, the tappet 38 for the exhaust valve 20 is depressed down against the top end of the pushing portion 54*b*.

The followers 36 are similar to those in the first embodiment concerning shape, how to be installed on the swing arms, and how to keep a sliding contact with the respective inner and outer surfaces of the guide groove.

The operation of the third embodiment is described as follows: When the crankshaft 24 starts rotation, the swing arms 35*a* and 35*b* convert the rotational motion of the crankweb 25*d* into the reciprocating motion of the tappet 38 to open the intake and exhause valves 21 and 20.

At this time, for instance, on the swing arm 35*a* for the intake valve 21, the follower 36 keeps a sliding contact with the guide groove 32, thus raising and lowering the tappet 38 by the lift equal to the offset of the highest position of the valve lifting portion 33*b* from the lowest position of the valve closing portion 33*a*.

As described above, according to the invention, the axial length of the output shaft is minimized by the length of a guide portion in comparison with the case having the guide portion on the output shaft, thus realizing a short crankcase. As the result, the crankcase in the engine block 10 becomes compact, which makes the engine smaller.

Even with the case of what is called cross-flow arrangement in which the exhaust valve is disposed opposite to the intake valve across the combustion chamber, provision of the guide portions in both the two crankwebs of the crankshaft to open respectively the intake and exhaust valves through the interlocking mechanisms guided by the guide portions, can eliminate the need for increasing the length of the crankshaft, thus realizing a small engine.

In addition, as described in the third embodiment, with the case where both the intake and exhaust valves are disposed on the same side of the engine block to open both valves by the single guide groove recessed in one crankweb, the invention can eliminate the need for providing any valve gear on the other crankweb, so minimizing the axial length of the crankshaft. As the result, the crankcase containing the crankshaft becomes small, and further the contour of the whole engine becomes compact.

Furthermore, with the general-purpose engine having a governor mechanism to keep engine speed constant, the governor can be disposed on the outer end surface of the crankweb having no guide groove for opening the valves, which makes it easier to ensure the space for disposing the governor.

Additionally, a further embodiment may be adopted, in which, for instance, a swing arm is used only on one hand, and a tappet is installed direct on a follower on the other hand, rather than employing the same system of interlocking mechanism for both the intake and exhaust valves, as each of aforesaid embodiments has shown.

The invention can also apply to the over-head type engine, not limited to the side-valve type engine exemplified in each of aforesaid embodiments.

It will be obvious to those skilled in the art that various changes may be made to the invention without departing from the spirit and scope thereof and therefore the invention is not limited by that which is shown in the drawings and described in the specification but only as indicated in the appended claims.

What is claimed is:

1. A valve gear unit adapted for use with a four cycle engine having valves comprising:

a monolithic crankshaft which includes output shafts, a plurality of crankwebs and a crankpin;

a valve guide portion on each crankweb of said plurality of crankwebs, each of said valve guide portions being positioned and arranged on each of said crankwebs to surround said crankshaft and having a shape to fold back around said crankshaft and an intersection to return back to a starting point in two turns of said crankshaft; and interlocking means for coupling the engine valves to an associated one of said valve guide portions, said guide portions being formed as guide grooves each having a concave side wall and a convex side wall, and each of said interlocking means having a follower having a flat portion maintaining a sliding contact with said convex side wall of said guide groove, and a convex portion maintaining a sliding contact with said concave side wall of said guide groove, said convex portion having a convex radius of curvature which is slightly smaller than the minimum radius of curvature of said guide-groove, and each said guide groove being designed in such a manner that portions of one complete inner circle and in the vicinity of said intersection are made from two outer and inner walls between which said follower slides, and the rest being made only from an inner wall on which said follower slides.

2. A valve gear unit adapted for use with a four cycle engine having valves comprising:

a monolithic crankshaft which includes output shafts, a plurality of crankwebs and a crankpin;

a valve guide portion on each crankweb of said plurality of crankwebs, each of said valve guide portions being positioned and arranged on each of said crankwebs to surround said crankshaft and having a shape to fold back around said crankshaft and an intersection to return back to a starting point in two turns of said crankshaft; and interlocking means for coupling the engine valves to an associated one of said valve guide portions, said guide portions being formed as guide grooves each having a concave side wall and a convex side wall, and each of said interlocking means having a follower having a flat portion maintaining a sliding contact with said convex side wall of said guide groove, and a convex portion maintaining a sliding contact with said concave side wall of said guide groove, said convex portion having a convex radius of curvature which is slightly smaller than the minimum radius of curvature of said guide-grooves, and each of said guide grooves including one section which forms a valve lifting section and another section which forms a valve closing section and said intersection between said valve lifting section and said valve closing section with said valve closing section having a shallower depth than said valve lifting section.

3. A valve gear adapted for the four-cycle engine having a crankshaft with crankwebs and further having an intake valve and an exhaust valve each having an associated valve tappet, comprising:

guide groove means being formed on end surfaces of the crankweb of a crankshaft, each groove means having a shape which folds around the crankshaft with an intersection as to return back to a starting point in two turns, and two interlocking means each having a follower respectively guided by said guide groove means and connected to an associated tappet to open the intake and the exhaust valves of said engine, and wherein said guide groove means includes an inner circular portion having sections in the vicinity of said intersection which sections are formed by two outer and inner walls between which said follower slides, with the rest of said circular portions consisting only of an inner wall on which said follower slides.

4. The valve gear as defined in claim 2 further including means for forcing each follower against bottom portions of each guide groove.

5. The valve gear as claimed in claim 2 wherein said valve closing section is concentric with the crankshaft and said valve lifting section is eccentric with respect to the crankshaft.

* * * * *